United States Patent [19]

Voorhies, Jr. et al.

[11] 3,974,060

[45]*Aug. 10, 1976

[54] PREPARATION OF HIGH V.I. LUBE OILS

[75] Inventors: Alexis Voorhies, Jr.; Glen P. Hamner, both of Baton Rouge, La.

[73] Assignee: Exxon Research and Engineering Company, Linden, N.J.

[ * ] Notice: The portion of the term of this patent subsequent to Apr. 4, 1989, has been disclaimed.

[22] Filed: Dec. 29, 1971

[21] Appl. No.: 213,830

Related U.S. Application Data

[63] Continuation-in-part of Ser. No. 875,509, Nov. 10, 1969, Pat. No. 3,654,130.

[52] U.S. Cl. ..... 208/59; 208/18; 208/58

[51] Int. Cl.[2] ..... C10G 23/02; C10G 37/06

[58] Field of Search ..... 208/57, 58, 59, 18

[56] References Cited

UNITED STATES PATENTS

| | | | |
|---|---|---|---|
| 2,915,452 | 12/1959 | Fear | 208/57 |
| 3,360,582 | 12/1967 | Mattox | 208/310 |
| 3,494,854 | 2/1970 | Gallagher et al. | 208/59 |
| 3,562,144 | 2/1971 | Child et al. | 208/59 |

*Primary Examiner*—Herbert Levine
*Attorney, Agent, or Firm*—A. D. Litt; Jay Simon

[57] ABSTRACT

High boiling hydrocarbon feeds are converted to high V.I. lube oils in high yields by hydrotreating in a first stage over a hydrogenation catalyst and then hydrocracking in a second stage over a faujasite-base catalyst, such as Pd on H-faujasite, under conditions such that less than 15 wt.% conversion, based on feed to the second stage, to products boiling below 650°F. occurs.

11 Claims, No Drawings

PREPARATION OF HIGH V.I. LUBE OILS

CROSS-REFERENCE TO RELATED APPLICATIONS

This is a continuation-in-part of copending application Ser. No. 875,509, filed Nov. 10 1969, now U.S. Pat. No. 3,654,130.

BACKGROUND OF THE INVENTION

1. Field of the Invention

This invenion relates to the preparation of high V.I. lubricating oils by two-stage hydroprocessing.

2. Description of the Prior Art

The characteristics of satisfactory lubricating oils and specific types of lubricating oils are known in the art. To provide lubricating oils which can be used for known and everchanging specific purposes and have acceptable characteristics, the refining processes generally require a careful selection of the crude base stock and an elaborate combination of refining steps sufficient to produce the desired product.

It is desirable therefore to be able to supply the demands of the consumer by utilizing as broad a feed spectrum as possible and particularly less desirable feeds in a refining process which minimizes the refining steps necessary to obtain a desired valuable product such as lubricating oil of high V.I. in good yields.

It is known that improved lubricating oils can be prepared by a plural stage hydrogenation process in which lubricating oil fractions are subjected to hydrogenation under different conditions prior to the hydrogenation designed to open the naphthene rings in polycyclic naphthenes. Such a process is taught by U.S. Pat. No. 2,915,452, issued Dec. 1, 1959, to Fear which uses any suitable metallic hydrogenating catalyst in each stage, although cobalt molybdate is preferred.

This process is limited in that its feedstocks are restricted to lubricating oil fractions and the catalysts used in the second stage are insufficiently selective to give a large yield of high V.I. oil.

SUMMARY OF THE INVENTION

In accordance with the invention, a two-stage hydrocracking process is employed to produce a high quality lubricating oil characterized by high V.I. The process comprises contacting a hydrocarbon feedstock, preferably a high boiling, heavy petroleum oil feedstock, with hydrogen and a hydrogenation catalyst, in the first stage, under conditions for maximizing hydrogenation of condensed ring aromatics present in the feedstock and for minimizing hydrocracking of the feedstock and hydrogenated products. The effluent from the first stage can be passed directly to the second stage of the process, or, alternatively, subjected to gas-liquid separation means, prior to second stage treatment, so as to remove any by-product ammonia, hydrogen sulfide and/or light hydrocarbons that may have formed.

The first stage effluent is contacted in the second stage with hydrogen and a faujasite-base catalyst impregnated with hydrogenation components under conditions for selectively converting a substantial portion of the polycyclic naphthenes present in the feedstock to single ring naphthenes and isomerizing a substantial portion of the isomerizable paraffins present in the feedstock. The second stage conditions are selected so that less than about 15 wt.%, preferably less than about 10 wt.%, conversion, based on feed to the second stage, to 650°F. and lighter products occurs.

Suitable process feedstocks include hydrocarbons, mixtures of hydrocarbons and, particularly, hydrocarbon fractions, the predominant portions of which exhibit initial boiling points above about 650°F. Preferably less than about 5 volume percent of the charge oil has a boiling point below about 700°F. Unless otherwise indicated, boiling points are taken at atmospheric pressure. Nonlimiting examples of useful process feedstocks include crude oil vacuum distillates from paraffinic or naphthenic crudes, i.e. waxy crudes, deasphalted residual oils, the heaviest fractions of catalytic cracking cycle oils, coker distillates and/or thermally cracked oils, heavy vacuum gas oils and the like. These fractions may be derived from petroleum crude oils, shale oils, tar sand oils, coal hydrogenation products and the like. In general the feedstock has a Saybolt Universal viscosity at 100°F. of at least about 50 seconds and more preferably at least about 100 seconds. Usually the feedstock will have a viscosity of not more than about 300 Saybolt Universal seconds at 210°F.

The first stage hydrogenation is conducted at a temperature ranging from about 650° to about 850°F., preferably from about 650° to about 725°F. The pressure ranges from about 1500 to about 5000 psig. The liquid hourly space velocity (V/V/Hr.) ranges from about 0.1 to 10.0, preferably from about 0.2 to 2.0. The hydrogen feed rate is between about 1000 and 10,000 SCF/bbl., preferably between about 2000 and 5,000 SCF/bbl. While the first stage reaction mechanism is not welldefined, it is postulated that conversion of a substantial portion of the aromatic compounds present in the feed, which would otherwise form undesirable products in the subsequent hydrogenation, into compounds which do not form undesirable products in the subsequent step, e.g. polynuclear naphthenes and the like occurs.

The catalyst in the first stage comprises one or more Group VIB or VIII metals of the Periodic Table such as cobalt, molybdenum, nickel, tungsten and the like, preferably in the combined state as the sulfide or oxide or mixtures thereof. The Periodic Table referred to herein is that described in "The Encyclopedia of Chemistry", Reinhold Publishing Corporation, 2nd Edition (1966) at 793. Thus, catalysts such as the sulfides of Ni—W, Ni—Mo, Co—Mo, Co—W or mixtures thereof on a suitable carrier such as bauxite, alumina, silica, silica-alumina and the like are contemplated as first stage catalyst. Preferably, the carrier will be a nonzeolite, although low zeolite content catalysts are also contemplated, i.e. less than about 20 wt.% zeolite, on total catalyst. A preferred catalyst comprises the sulfide of Ni—W on $Al_2O_3$.

The second stage of the process is conducted at less severe conditions than the first stage. The temperature ranges between about 450° and about 650°F., although temperatures as high as about 700°F. may be used. The feed rate is generally higher than the first stage feed rate ranging between about 0.1 and 10 V/V/Hr., preferably between about 0.5 and 5 V/V/Hr. Pressure and recycle gas rate are about the same as in the first stage.

During the second stage hydrogenation, conversion to products boiling below 650°F. is kept below about 15 wt.% preferably below about 10 wt.%, while the polynuclear naphthenes, including those polynuclear naphthenes which existed in the original feedstock and those formed in the first stage, are converted largely to single-ring naphthenes. The conversion of polynuclear naphthenes to single ring naphthenes results in a large increase of the V.I. of the product. Also in the second stage, the normal paraffins are extensively isomerized to branch chain structures thereby increasing lube yield and V.I. of the product. It is noted that the explanation for the observed V.I. increase is speculative, in view of the fact that the reaction chemistry is not well defined.

The second stage catayst is a zeolite-base catalyst, preferably a faujasite-base catalyst. The alkali metal atoms, silicon, aluminum and oxygen in the zeolite are arranged in the form of an aluminosilicate salt in a definite and consistent crystalline structure. The structure contains a large number of small cavities, interconnected by a number of still smaller holes or channels. While both natural and synthetic faujasite can be used, the latter is more readily accessible and is therefore preferred. Methods for their preparation are described in U.S. Pat. No. 3,130,007.

The aluminosilicate can be in the hydrogen form, in the polyvalent metal form, or in the mixed hydrogen-polyvalent metal form. The polyvalent metal or hydrogen form of the aluminosilicate component can be prepared by any of the well-known methods described in the literature. Representative of such methods is ion-exchange of the alkali metal cations contained in the aluminosilicate with ammonium ions or other easily decomposable cations such as methyl-substituted quaternary ammonium ions. The exchanged alumino-silicate can then be heated at elevated temperatures to drive off ammonia, thereby producing the hydrogen form of the material. Alternatively, the ammonium ion-exchanged form can be back-exchanged with solutions of the desired salts thereby producing the polyvalent metal form.

The form of the hydrogen aluminosilicate can be employed as such, or can be subjected to a steam treatment at elevated temperatures to effect stabilization, thereof, against hydrothermal degradation. The steam treatment, in many cases, also appears to effect a desirable alteration in crystal structures resulting in improved selectivity.

The mixed hydrogen-polyvalent metal forms of the aluminosilicates are also contemplated. In one embodiment the metal form of the aluminosilicate is ion-exchanged with ammonium cations and then partially back-exchanged with solutions of the desired metal salts until the desired degree of exchange is achieved. The remaining ammonium ions are decomposed later to hydrogen ions during thermal activation.

Suitably, the exchanged polyvalent metals are transition metals and are selected from Groups VIB and VIII of the Periodic Table. Preferred metals include nickel, molybdenum, tungsten and the like.

In addition to the ion-exchanged polyvalent metals, the aluminosilicate may contain as nonexchanged constituents one or more hydrogenation components comprising the transitional metals, preferably selected from Groups VIB and VIII of the Periodic Table and their oxides and sulfides. Such hydrogenation components may be combined with aluminosilicate by any method which gives a suitably intimate admixture, such as by impregnation. Examples of suitable hydrogenation metals, for use herein, include nickel, tungsten, molybdenum, platinum, and the like, and/or the oxides and/or sulfides thereof. Mixtures of any two or more of such components may also be employed. In one embodiment, the catalyst comprises a faujasite base impregnated with a metallic hydrogenation component comprising Group VIB and/or Group VIII metals and/or the oxides and/or sulfides of said metals such as cobalt, nickel, tungsten, molybdenum, the platinum group metals and mixtures thereof. Thus, mixtures of sulfides of metals such as nickel-tungsten, nickel-molybdenum, cobalt-tungsten and cobalt-molybdenum, are contemplated.

The silica:alumina mole ratio of the second stage catalyst is greater than about 2.5 and preferably ranges between about 2.5 and 10, most preferably between about 3 and 6. The pore diameter size of the crystalline aluminosilicate can range from about 5 to 15 A, and preferably from about 6 to 13 A. The alkali metal oxide content of the catalyst should be less than about 2.0 wt.%, preferably less than 0.5 wt.%, based on the total aluminosilicate composition.

The most preferred catalyst comprises a noble metal such as palladium or platinum on H-faujasite.

It is noted that conversion, in the second stage, of hydrocarbon components boiling above 650°F., to materials boiling below 650°F., must be maintained below about 15 wt.%, based on second stage feed.

The product effluent of the two-stage process of this invention is separated by conventional techniques such as by distillation into desired fractions, e.g. 320°F. and lighter (if any), 320°–550°F., 550°–650°F., 650°–800°F. and 800°F. and higher. The fraction boiling 650°–800°F. may be recycled to the first stage for further V.I. improvement. The 650°–800°F. fraction and the 800°F.+ fractions are usually combined and dewaxed to produce the desired high V.I. lubricating oil. Removal of the waxy material in desired amounts is accomplished by any of the well-known techniques used to give desired low pour point oils. Dewaxing to obtain exceptionally low pour points is essential for some lubes and may be accomplished using one or more steps of solvent extraction with a solvent such as propane, methyl ethyl ketone, toluene and others with suitable chilling and filtering between steps followed by recovery of the solvent by distillation. This dewaxing step is part of this invention only to the extent required to obtain desired pour point lube oils.

If desired, the combined dewaxed fraction may be further upgraded by treating it with anhydrous HF as described in U.S. Pat. No. 3,463,724 issued Aug. 26, 1969 to Langlois et al. or with any of the treating agents disclosed in Table I of column 4 of said patent or with any other similar treating agent known in the art.

In carrying out this invention any suitable equipment arrangement may be used for contacting the oil with the catalyst in the presence of excess hydrogen in either stage. For example, the catalyst may be maintained as one or more fluidized beds, gravitating beds, or fixed beds of small particles, through which the oil and hydrogen are passed, upflow or downflow, concurrent or countercurrent. A slurry of catalyst in oil may also be used. Vapor phase, liquid phase, or mixed phase contacting may be used. Usually the catalyst is in the form of small pellets or rod-like extrusions contained in a reactor as a plurality of fixed beds and the oil and hydrogen are passed together downflow through the beds at controlled temperature, pressure and flow rates. The process may be conducted as a batch or continuous operation. The effluent is cooled to separate product oil from hydrogenrich gas which is recycled.

Contact time of the catalyst and feed in the first and second stages is subject to wide variation, being dependent in part upon the temperature and space velocities employed. In general, feed rates in the first stage may range, for example, from 0.1 to 10 V/V/Hr. and preferably from 0.2 to 2 V/V/Hr. Contact times in the second stage may range from 15 to 500 minutes and preferably from 60 to 120 minutes.

DESCRIPTION OF THE PREFERRED EMBODIMENTS

The invention will be further understood by reference to the following examples which include a preferred embodiment of the invention.

EXAMPLE 1

A mixture (boiling 650°F.+) of 60% deasphalted oil and 40% heavy vacuum gas oil both from West Texas sour crude was first processed at nonconversion conditions, 680°F., 2500 psig, 0.25 V/V/Hr. with 4000 $SCFH_2$ per bbl. of feed over a $NiW—Al_2O_3$ catalyst (sulfided) to saturate the aromatics present in the feed. The product was stabilized at atmospheric conditions and the stabilized product was passed over Pd on hydrogen-faujasite catalyst at similar conditions except for temperature and feed rate. The following data were obtained:

| Catalyst | 1st Stage Ni-W-Alumina | Ni-W-Alumina | 2nd Stage | Pd-H-Faujasite | |
|---|---|---|---|---|---|
| Run | 1 | 2 | 3 | 4 | 5* |
| Process Conditions | | | | | |
| Temperature, °F. | 680 | 770 | 500 | 600 | 575 |
| Pressure, Psi | 2500 | 2500 | ——— | 2500 | ——— |
| Gas Rate, SCF/Bbl. | 4000 | 4000 | ——— | 4000 | ——— |
| V/V/Hr. | 0.25 | 0.53 | 1.6 | 2.8 | 3.6 |
| Lube Yield, 650°F. +, Wt.% | 95 | 73.1 | 93.0 | 91.7 | 70.7(68.5)** |
| Lube Inspections | | | | | |
| 650–800°F. Fraction, Wt.% | | 16.6 | 9.6 | 9.7 | 11.9** |
| °API | | 31.3 | 29.6 | 29.6 | |
| V.I. (Waxy) | | 91 | | —— 76 —— | |
| 800°F. + Fraction, Wt.% | | 56.5 | 83.4 | 82.0 | 56.6** |
| °API | 28.1 | 30.5 | 29.0 | 31.0 | 30.0 |
| V.I. (Waxy) | — | 114 | 102 | 111 | 93 |
| V.I. (Est. on DWO) | | 102 | 90 | 99 | 81 |
| VSU at 100°F. | | 620 | 790 | 778 | 1220 |
| VSU at 210°F. | | 71.5 | 89.8 | 90.0 | 96.8 |
| $N_2$, ppm | 7 | — | — | 1.7 | — |
| S, ppm | 16 | | — | 1.0 | — |

*800°F. + fraction, from previous 2 runs with Pd on faujasite catalyst, used as feed.
**Original feed basis, only 2.8 wt.% of recycle feed was converted to 650–800°F. lube fraction.

The above data show that very high V.I. oils can be obtained by a two-stage process in which a faujasite-base catalyst is used in the second stage provided the conversion to 650°F. and lighter products be kept under 15 wt.%, based on second stage feed. If a nonzeolitic catalyst is used in the second stage high V.I. oils can be obtained only at a sacrifice in yield. (Compare column 2 with columns 3 and 4). When the conditions in the second stage are set so that substantial cracking to lighter products occurs, both yield and V.I. of the lube oil product decrease (see column 5 as compared to column 2). Obviously, the V.I. level of the 650°–800°F. fraction can be increased by recycling with the result that the V.I. will be 91 or greater, in which case, dewaxing of the combined fractions gives greater overall lube yield of excellent V.I.

What is claimed is:

1. A process for producing high V.I. lubricating oils comprising contacting a petroleum oil feedstock in a first stage with hydrogen and a catalyst comprising an amorphous base containing from 0 to less than about 20 wt.% zeolite, on total catalyst, and a metal selected from Groups VIB and VIII of the Periodic Table, or the oxides or sulfides of said metals, or mixtures thereof, at a temperature ranging from about 650° to about 850°F., at a pressure ranging from about 1500 to about 5000 psig and at a liquid hourly space velocity ranging from about 0.1 to about 10.0 V/V/Hr., contacting at least a portion of the first stage effluent in a second stage at less severe conditions of temperature and space velocity with hydrogen and a zeolite-base catalyst comprising a faujasite base and hydrogenation component selected from the group consisting of the metals from Groups VIB and VIII of the Periodic Table, their oxides and sulfides and mixtures thereof, said second stage contacting conducted at a temperature ranging from about 450° to about 700°F., at a pressure ranging from about 1500 to about 5000 psig, and at a liquid hourly space velocity ranging from about 0.1 to about 10.0 V/V/Hr., so that conversion to products boiling below 650°F. in said second stage is below about 15%.

2. The process of claim 1 wherein the first stage catalyst comprises metals or sulfides of metals selected from the group consisting of cobalt, molybdenum, nickel, tungsten and mixtures thereof on an amorphous carrier comprising alumina, silica or mixtures thereof.

3. The process of claim 2 wherein said amorphous carrier is alumina or silica-alumina.

4. The process of claim 1 wherein the first stage contacting temperature ranges from about 650° to about 775°F. and the first stage space velocity ranges from about 0.2 to about 2.0 V/V/Hr.

5. The process of claim 4 wherein the second stage contacting temperature ranges from about 450° to about 650°F. and the second stage space velocity ranges from about 0.5 to about 5.0 V/V/Hr.

6. The process of claim 5 wherein the amount of conversion to products boiling below about 650°F., in the second stage, is below about 15 wt.% based on second stage feed.

7. The process of claim 1 wherein said second stage catalyst comprises a faujasite impregnated with a hydrogenation component comprising a metal or oxide or sulfide of said metal selected from the group consisting of cobalt, nickel, molybdenum, tungsten, the platinum group metals and mixtures thereof.

8. A two stage process for producing lubricating oils having a high V.I. from petroleum oil feedstocks which are characterized in that less than 5 volume % of the oil has a boiling point below about 700°F. as well as having a Saybolt Universal Viscosity at 100°F. of at least 50 seconds, which comprises contacting said oil in a first stage with hydrogen and a first stage hydrogenation catalyst comprising a metal or oxide or sulfide of said metal selected from the group consisting of cobalt, molybdenum, nickel, tungsten and mixtures thereof on an amorphous-base carrier selected from the group consisting of alumina and silica-alumina at a temperature of about 650° to 775°F., a pressure within the approximate range from 1500 to 5000 psig and a liquid hourly space velocity within the approximate range from 0.2 to 2 V/V/Hr. so as to hydrogenate aromatics contained within said oil to naphthenes and subsequently contacting at least a portion of the product effluent from said first stage in a second stage with hydrogen in the presence of a zeolite base catalyst under less severe conditions of temperature and liquid hourly space velocity than are used in said first stage so that conversion to products boiling below 650°F. in said second stage is below about 15% said second stage conditions including a temperature of about 450° to 650°F. and a liquid hourly space velocity of about 0.5 to 5 V/V/Hr. and said second stage catalyst comprising a faujasite impregnated with a metallic hydrogenation component comprising a metal or oxide or sulfide of said metal selected from the group consisting of cobalt, nickel, molybdenum, tungsten, the platinum group metals and mixtures thereof.

9. The process of claim 8 in which the first stage catalyst comprises a sulfided nickel-tungsten on alumina.

10. The process of claim 8 in which the second stage catalyst comprises palladium on the hydrogen form of faujasite.

11. The process of claim 8 in which the second stage catalyst comprises a faujasite impregnated with the sulfide of a mixture of metals selected from the group consisting of nickel-tungsten, nickel-molybdenum, cobalt-tungsten and cobalt-molybdenum.

* * * * *